US010189296B2

(12) United States Patent
Dorpmund et al.

(10) Patent No.: US 10,189,296 B2
(45) Date of Patent: Jan. 29, 2019

(54) INSTRUMENT, SUCH AS A WRITING PEN, MAKE-UP PEN, TOOL OR TOY AND METHOD FOR USING SUCH AN INSTRUMENT

(71) Applicants: Patrick Dorpmund, Chaponost (FR); Pedro Mariano, Vaulx en Velin (FR); Jacques Ferret, Paris (FR)

(72) Inventors: Patrick Dorpmund, Chaponost (FR); Pedro Mariano, Vaulx en Velin (FR); Jacques Ferret, Paris (FR)

( * ) Notice: Subject to any disclaimer, the term of this patent is extended or adjusted under 35 U.S.C. 154(b) by 235 days.

(21) Appl. No.: 15/315,890

(22) PCT Filed: Jun. 5, 2015

(86) PCT No.: PCT/EP2015/062548
§ 371 (c)(1),
(2) Date: Dec. 2, 2016

(87) PCT Pub. No.: WO2015/185711
PCT Pub. Date: Dec. 10, 2015

(65) Prior Publication Data

US 2017/0087922 A1 Mar. 30, 2017

(30) Foreign Application Priority Data

Jun. 5, 2014 (FR) ..... 14 55129

(51) Int. Cl.
*B43K 23/06* (2006.01)
*A45D 40/24* (2006.01)
(Continued)

(52) U.S. Cl.
CPC ..... *B43K 23/06* (2013.01); *A45D 40/20* (2013.01); *A45D 40/205* (2013.01); *A45D 40/24* (2013.01);
(Continued)

(58) Field of Classification Search
CPC ..... B43K 23/06
(Continued)

(56) References Cited

U.S. PATENT DOCUMENTS 5,233,715 A 8/1993 Huang

FOREIGN PATENT DOCUMENTS

DE 86 31 918 U1 2/1987
EP 0 324 321 A2 7/1989
(Continued)

OTHER PUBLICATIONS

International Search Report, dated Aug. 4, 2015, from corresponding PCT application.

(Continued)

*Primary Examiner* — David Walczak
*Assistant Examiner* — Joshua Wiljanen
(74) *Attorney, Agent, or Firm* — Young & Thompson

(57) ABSTRACT

An instrument includes a body, at least two modules, each separate from the one or other modules, including an operative portion and being movable relative to the body and, for each module, a mechanism for guiding the translation and rotation of the module along the body, the module being movable relative to the body, successively in translation parallel to a first axis and in rotation about a second axis perpendicular to the first axis and which is rigidly connected to the body, between an inoperative configuration in which the operative portion of the module is housed inside the body and a use configuration in which the operative portion of the module projects from the body. The two modules or two of the modules are arranged on either side of a single arm of the body, which extends along the first axis from a base to an end of the body.

15 Claims, 15 Drawing Sheets

(51) Int. Cl.

| | |
|---|---|
| ***B43K 24/12*** | (2006.01) |
| ***B43K 27/00*** | (2006.01) |
| ***A45D 40/20*** | (2006.01) |
| ***B43K 8/02*** | (2006.01) |
| ***B43K 19/02*** | (2006.01) |
| ***B43K 29/02*** | (2006.01) |
| ***B43K 29/05*** | (2006.01) |
| *A63H 33/06* | (2006.01) |
| *A63H 33/04* | (2006.01) |
| *A63H 3/16* | (2006.01) |

(52) U.S. Cl.
CPC ..... *B43K 8/02* (2013.01); *B43K 8/024* (2013.01); *B43K 19/02* (2013.01); *B43K 24/12* (2013.01); *B43K 27/00* (2013.01); *B43K 29/02* (2013.01); *B43K 29/05* (2013.01); *A63H 3/16* (2013.01); *A63H 33/046* (2013.01); *A63H 33/067* (2013.01)

(58) Field of Classification Search
USPC ..... 401/29, 31; 7/168
See application file for complete search history.

(56) References Cited

FOREIGN PATENT DOCUMENTS

| | | | |
|---|---|---|---|
| GB | 2 197 624 | A | 5/1988 |
| WO | 88/04221 | A | 6/1988 |
| WO | 95/19270 | A1 | 7/1995 |
| WO | 2007/139319 | A | 12/2007 |

OTHER PUBLICATIONS

FR Search Report, dated Feb. 23, 2015, from corresponding FR application.

24
210
220
10
12
204
17
202
170
271
17
273
171
272
172
173
210
220
23

41
40
143
46
43
145
42
44
14
45
10
15
12
15
13
230
181
18
182
183
184

21
210
30
13
15
26
231
232
230
16
18
22
221
222
220
20

21
210
14
30
26
43
42
264
141
42
16
142
22
220
20

281
282
28
26
XIV
232
231
230
Y20
233
220
223
20
27
271
272
273
274
200
XIV
12
17
13
10
16
145
144
141
14
142
143

18
181
182
183
184

210
221
222
220

INSTRUMENT, SUCH AS A WRITING PEN, MAKE-UP PEN, TOOL OR TOY AND METHOD FOR USING SUCH AN INSTRUMENT

FIELD OF THE INVENTION

The present invention relates to an instrument, for example a writing pen, a makeup pen, a tool or a toy. The invention also relates to a method for applying such an instrument.

Within the scope of the present invention, an instrument is defined as a device adapted so as to be handled and freely moved by a user by means of a single hand or both hands.

BACKGROUND OF THE INVENTION

Such an instrument generally comprises a body and at least one active portion, for example a pen tip, a makeup brush or a screwdriver tip. In a known way, the active portion may be positioned at the end of a movable module with respect to the body.

WO-A-88/04221 describes an instrument of the tool type, comprising a body, a slider and several modules. Each module is provided with an active portion. The slider is housed in the body and translationally movable relatively to the body. When the slider is taken out of the body, each module is movable in rotation relatively to the slider, so as to allow the use of the active portion.

WO-A-2007/139319 describes different embodiments of an instrument of the writing pen type, comprising a body, a lid system and several modules positioned in the body. Each module is provided with an active portion. Each module is translationally movable relatively to the body, so as to set aside the lid and allow the use of the active portion.

EP-A-0 324 321, on which is based the preamble of claim 1, describes an instrument of the writing pen type, comprising a body and two modules. Each module is equipped with two active portions respectively positioned at opposite ends of the module. Each module is movable in rotation relatively to the body, so as to position an active portion selected facing an aperture for letting through the body. Next, each module is translationally movable relatively to the body, so as to arrange the active portion in the passage aperture.

SUMMARY OF THE INVENTION

The object of the present invention is to propose an improved instrument, notably in terms of ergonomics.

For this purpose, the object of the invention is an instrument comprising:

- a body adapted for being grasped by a user;
- at least two modules, each module being independent of the other module(s), including an active portion and being movable relatively to the body; and
- for each module, a mechanism for guiding the module in translation and in rotation along the body, the module being movable relatively to the body successively in a translation parallel to a first axis and in a rotation around a second axis which is perpendicular to the first axis and which is secured to the body, between a rest configuration wherein the active portion of the module is housed in the body and a use configuration wherein the active portion of the module protrudes out of the body, wherein both modules or two of the modules are positioned on either side of a same arm of the body, which extends along the first axis from a base of the body as far as one end of the body, the respective active portions of both of these modules being housed in the base in the rest configuration and extending along the first axis beyond the end of the body in the use configuration.

Thus, the instrument according to the invention is practical, simple and rapid to use. Further, the instrument provides great possibilities of modularity and of adaptation to the need, depending on the targeted application and on the preferences of the user. The invention gives the possibility of doing without an additional lid system. Indeed, the body itself makes up the lid giving the possibility of protecting the active portion in the rest configuration. Further, the invention gives the possibility of doing without a slider arranged between the body and the module. Indeed, the module itself forms the slider, translationally movable relatively to the body. Finally, when both modules positioned on either side of a same arm are in a use configuration, the instrument according to the invention has at the same end of its body both respective active portions of these two modules, so as to be able to alternately use both of these active portions easily and rapidly.

According to other advantageous features of the instrument of the invention:

- The mechanism associated with each module comprises elements belonging to the corresponding arm of the body and of the elements belonging to the module, notably without any additional part interposed between the body and the module.
- The mechanism associated with each module comprises a surface of the corresponding arm of the body and a surface of the module, both of these surfaces being complementary and sliding against each other during the translation.
- The mechanism associated with each module comprises a groove secured to a first part from among the corresponding arm of the body and the module, this groove defining the second axis, and a protruding element secured to a second part from among the corresponding arm of the body and the module, this protruding element being movable in translation and in rotation in the groove.
- The groove comprises a first portion in which the protruding element is movable in translation but not in rotation and a second portion in which the protruding element is movable in rotation.
- In the rest configuration and in the use configuration, a major part of each module is located out of the body.
- Each module is movable towards a setback configuration in which a disassembling of the module relatively to the body is allowed by the associated mechanism, while said disassembling is prevented by the associated mechanism in the rest configuration and in the use configuration.
- The instrument comprises a blocking device which is movable relatively to the body between a safety position, in which the blocking device interferes with a portion of the mechanism for preventing displacement of both modules positioned on either side of the arm, as far as the setback configuration, and a release position in which the blocking device is disengaged from this portion of the mechanism for allowing displacement of both modules positioned on either side of the arm, as far as the setback configuration.
- The blocking device comprises a cap, which is preferably movable relatively to the body between both modules positioned on either side of the arm, between the safety position and the release position.

The groove comprises a third portion in which the protruding element is movable in rotation, the mechanism allowing displacement of the modules as far as the setback configuration.

Each module includes an active portion different from that of the other module(s).

Four modules and two arms are provided, the body and the mechanism being symmetrical relatively to a central axis.

The object of the invention is also a method for applying an instrument as defined above, wherein a transition of each module from the rest configuration to the use configuration comprises the following steps:

a) displacing the module in translation relatively to the body according to a first direction defined in parallel to the first axis;

b) displacing the module in rotation around the second axis relatively to the body, notably in rotation between 175 and 185 degrees around the second axis, in particular in rotation by 180 degrees around the second axis; and c) displacing the module in translation relatively to the body according to a second direction defined in parallel to the first axis and opposite to the first direction, as far as the use configuration.

According to an advantageous feature of this method, the disassembling of each module relatively to the body comprises following steps:

a) displacing the blocking device as far as the release position;

b) displacing the module in translation by relatively to the body as far as the setback configuration; and c) displacing the module in translation relatively to the body according to a third direction perpendicular to the first axis, by moving away from the body.

According to another advantageous feature of this method, the disassembling of each module relatively to the body comprises following steps:

a) displacing the module in translation relatively to the body according to the first defined direction parallel to the first axis;

b) displacing the module in rotation around the second axis relatively to the body, notably in rotation between 85° and 95° around the second axis, in particular in rotation at 90° around the second axis;

c) displacing the module in translation relatively to the body according to the second defined direction parallel to the first axis and opposite to the first direction, as far as the setback configuration, the protruding element being positioned in the third portion of the groove;

d) displacing the module in translation relatively to the body according to a third direction perpendicular to the first axis, by moving away from the body.

BRIEF DESCRIPTION OF THE DRAWINGS

The invention will be better understood upon reading the description which follows of three embodiments, only given as a non-limiting example and made with reference to the appended drawings wherein.

DETAILED DESCRIPTION OF THE INVENTION

Figure 1:
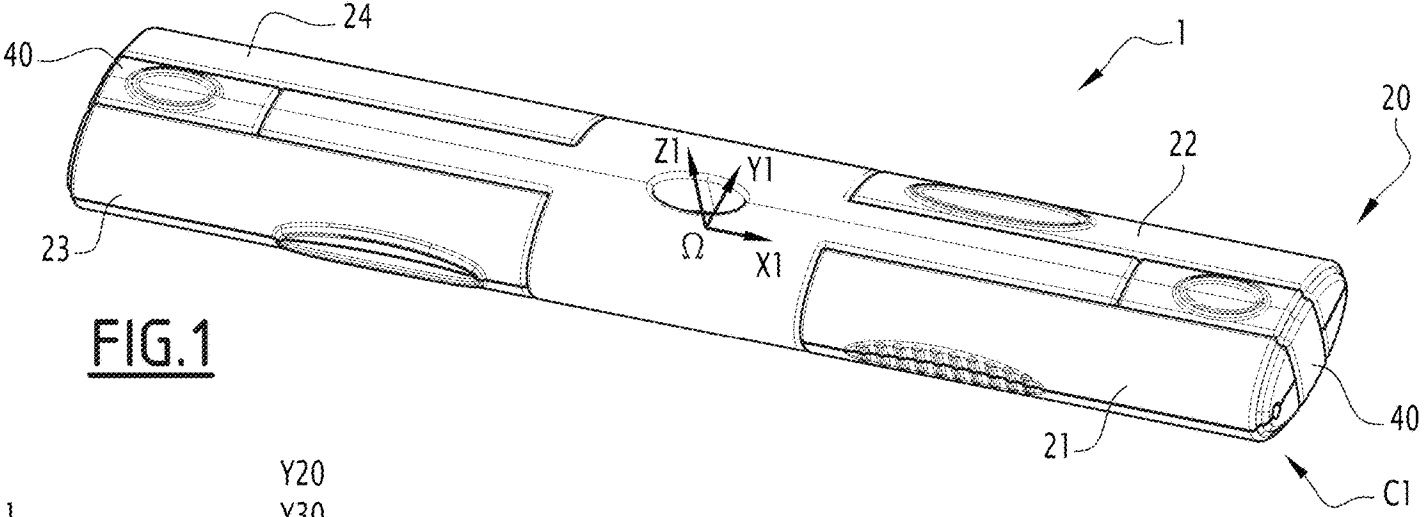
FIG. 1 is a perspective view of an instrument according to a first embodiment of the invention, of the writing pen type, comprising a body, two caps and four modules, shown in a rest configuration.

In FIGS. 1 to 28 is illustrated an instrument 1 according to the invention, of the writing pen type.

With a purpose of localization in space, an orthogonal reference system is defined at the center of the pen 1, comprising axes X1, Y1 and Z1 which are perpendicular to each other and extend respectively along the length, the width and the height of the pen 1.

The pen 1 comprises a body 10, four modules 20, a guiding mechanism 30 and two caps 40. The pen 1 has an elongated shape along the X1 axis. The overall shape of the pen 1 is provided for facilitating its handling, as well as the handling of its different constitutive elements by a user.

The body 10 is preferably in one piece, i.e. consisting of a single part. Alternatively, the body 10 may be formed with several assembled parts. The body 10 may be in plastic material, in metal, in wood, in plant starch or any other material suitable for the targeted application. The body 10 may be manufactured by injection, molding, machining or any suitable method for the material used.

Figure 5:
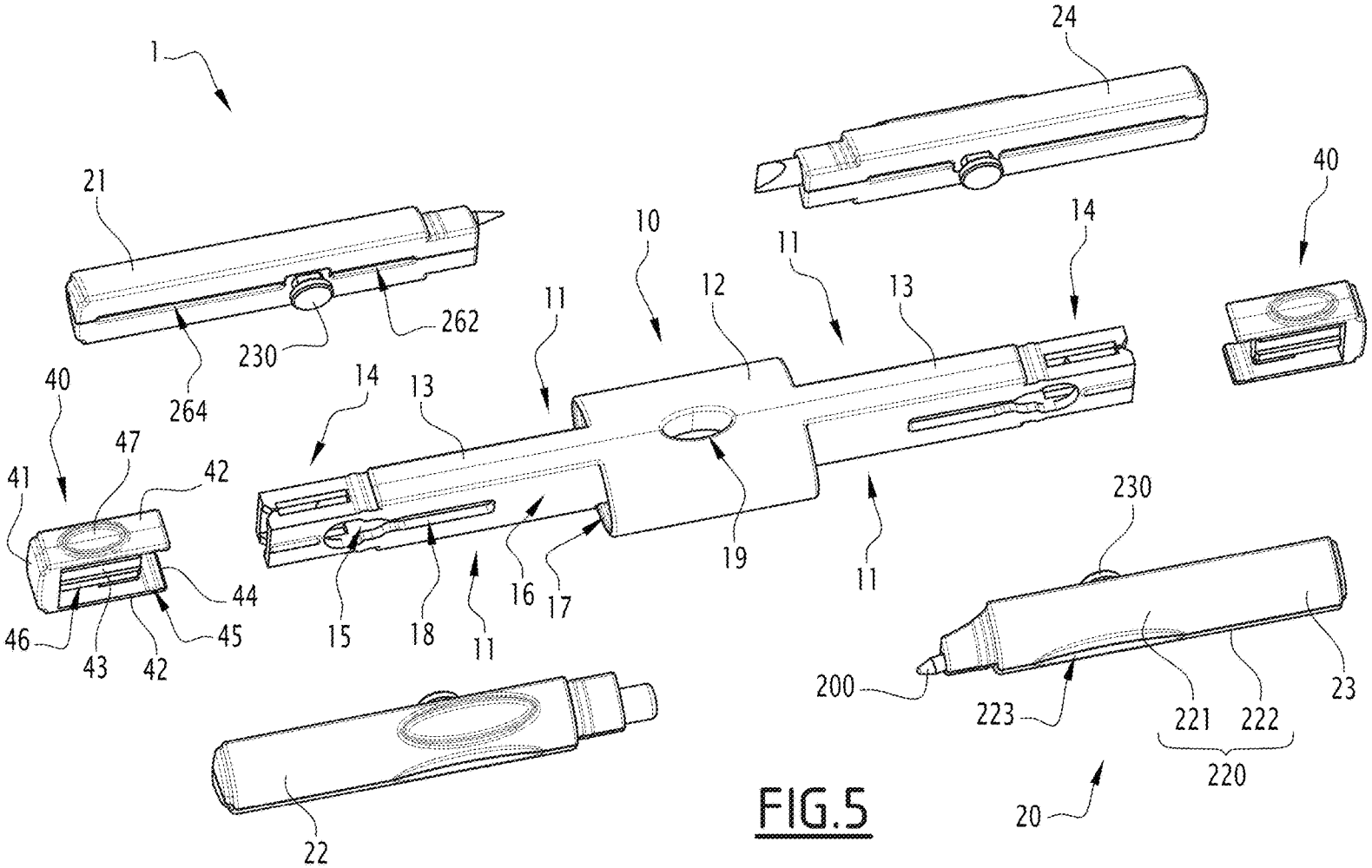
FIG. 5 is an exploded perspective view of the pen of FIGS. 1 to 4.

The body 10 delimits four spaces 11 for receiving the modules 20, as shown in FIG. 5. The body 10 comprises a base 12 and two arms 13. The base 12 has a rectangular shape in section in a plane comprising the axes X1 and Y1 and an oval shape in section in a plane comprising the axes Y1 and Z1. Each arms 13 extends along the axis X1, from the base 12 as far as one end 14 which is configured for cooperating with a cap 40. Each arm 13 is hollow and includes an internal cavity 15 which extends along the X1 axis, as far as in the base 12. Each arm 13 includes two substantially planar faces 16 parallel with each other and perpendicular to the Y1 axis. Facing each face 16, the base 12 includes a housing 17 for receiving one end of a module 20. The four spaces 11 are delimited by the four faces 16 and the four housings 17. Each arm 13 also includes two grooves 18, each provided for receiving a portion of a module 20 and formed between the cavity 15 and the corresponding face 16. The base 12 moreover comprises a central orifice 19, which has an oval shape centered on the Y1 axis. The orifice 19 is provided for receiving accessories, for example a magnet or a small chain.

Figures 7, 8, 9, 10:
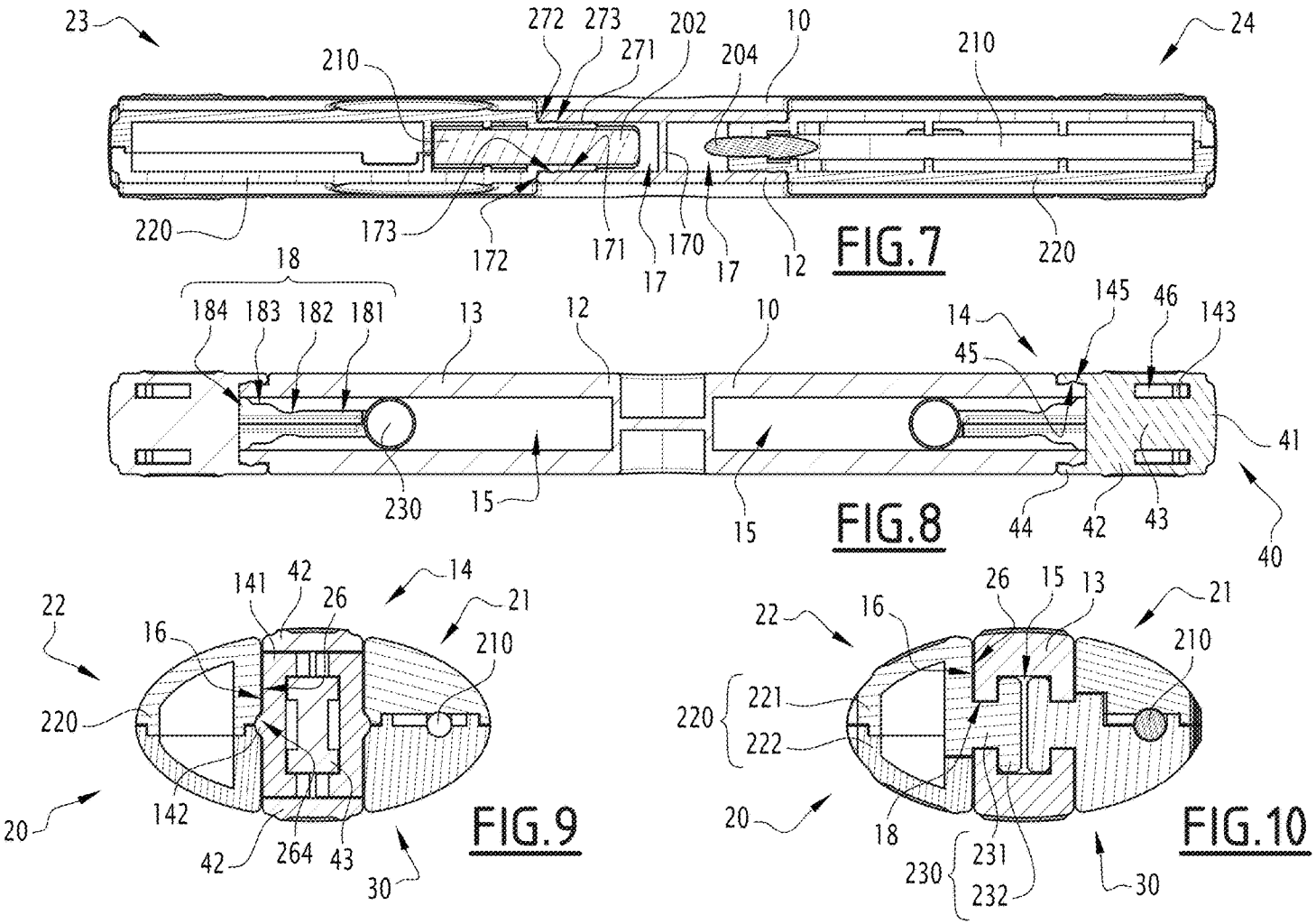
FIGS. 7 and 8 are respectively sectional views along the lines VII-VII and VIII-VIII in FIG. 3.
FIGS. 9 and 10 are sectional views respectively along the lines IX-IX and X-X in FIG. 4.

In the base 12, a separation wall 170 is arranged between neighboring housing 17, as shown in FIG. 7. Each housing 17 includes an internal surface 171 and an external abutment surface 172. The surface 171 includes a recess 173, the function of which is detailed further on.

In the arms 13, each groove 18 includes different portions 181, 182, 183 and 184 connected together. The portion 181 has an elongated shape along the X1 axis and a reduced width along the Z1 axis. The portion 182 forms a localized shrinkage of the groove 18 and has an even more reduced width than the portion 181 along the Z1 axis. The portion 183 has a circular shape and has a greater diameter than the width of the portion 181. The portion 184 has a circular shape and has a larger diameter than the diameter of the portion 183. The portions 183 and 184 overlap. The portion 183 has a central axis Y30, parallel to the Y1 axis. The axis Y30 is fixed relatively to the body 10, in other words it is secured to the body 10.

Figures 11, 12, 13, 14:
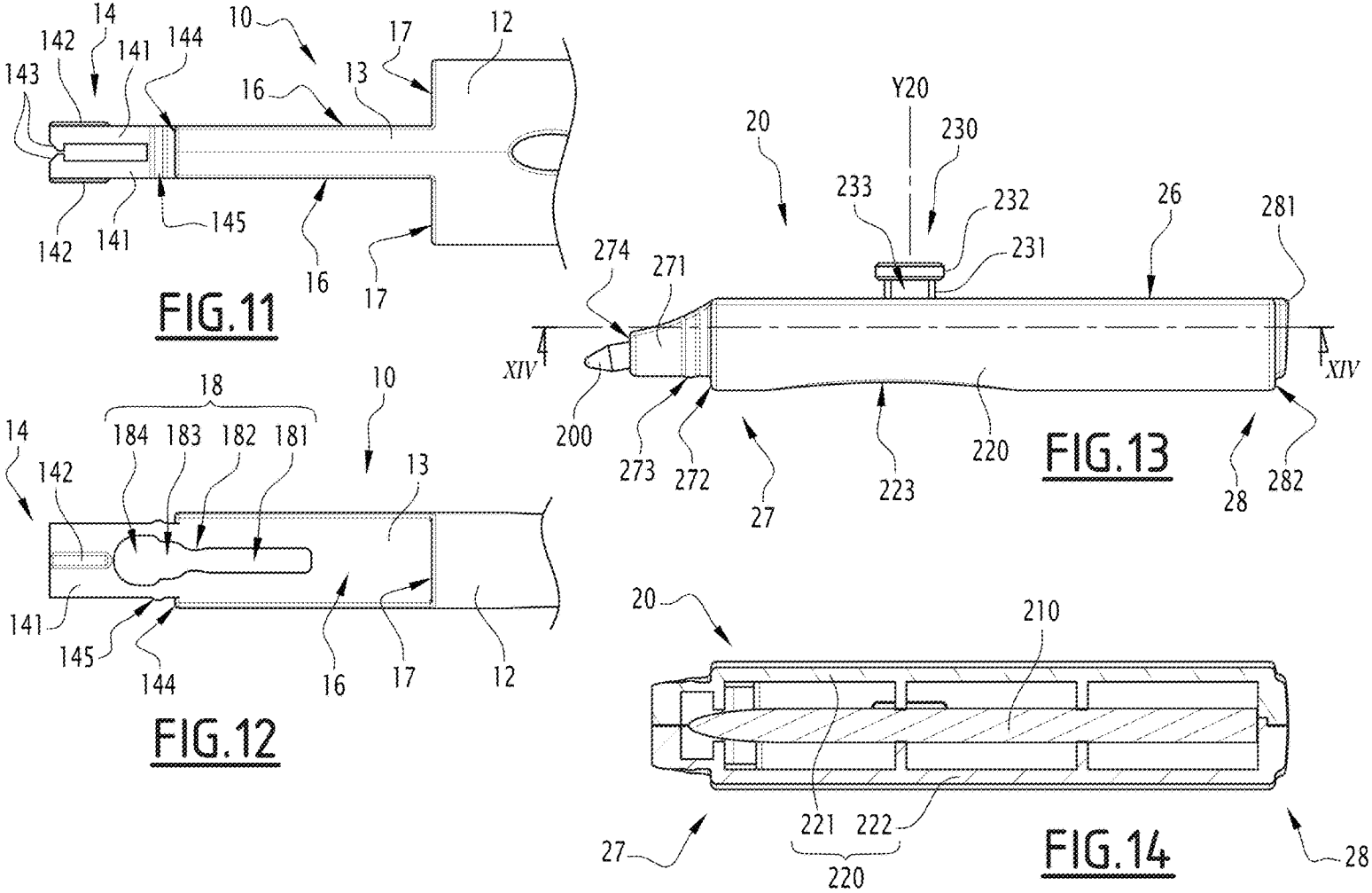
FIG. 11 is a partial view similar to FIG. 3, only showing the body.
FIG. 12 is a view along the arrow XII in FIG. 11.
FIG. 13 is a partial view similar to FIG. 3, at large scale, only showing one of the modules.
FIG. 14 is a sectional view along the line XIV-XIV in FIG. 13.
Figure 17:
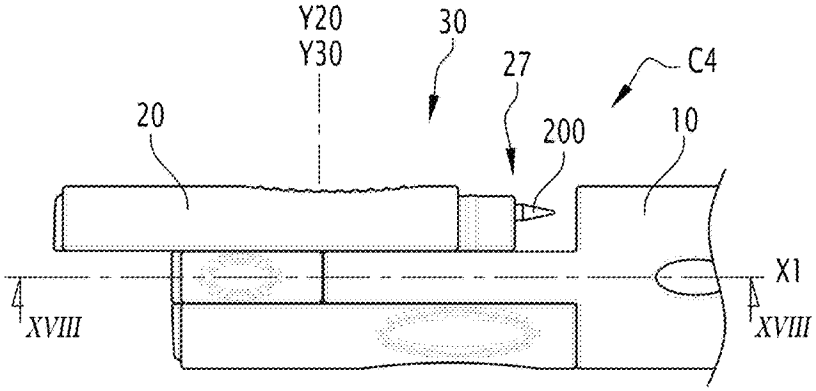
FIG. 17 is a view similar to FIG. 15, showing the module in a pivoting configuration, before rotation relatively to the body.
Figure 18:
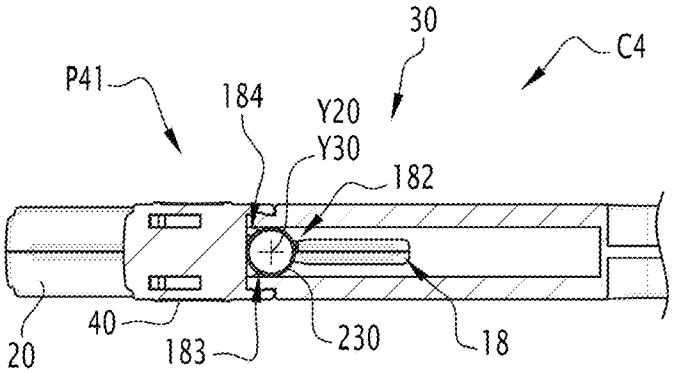
FIG. 18 is a sectional view along the line XVIII-XVIII in FIG. 17.

Each end 14 includes two branches 141 forming a fork, as notably shown in FIGS. 11 and 12. Each end 14 includes two ribs 142, which extend parallel to the X1 axis on the faces 16, on the outer side of the branches 141. Each end 14 includes four hooks 143, i.e. two hooks 143 formed on the inner side of each of the branches 141, at the opening of the cavity 15. Each end 14 includes two abutment surfaces 144 formed perpendicularly to the X1 axis, on the border of the branches 141. Each end 14 includes two side protrusions 145 which extend parallel to the Y1 axis, between the branches 141 and the abutment surface 144.

Each module 20 is movable between different configurations C1, C2, C3, C4, C5 and C6, i.e. a rest configuration C1, a use configuration C2, an intermediate configuration C3, a pivoting configuration C4, a setback configuration C5 and a dismantled configuration C6, which will be detailed hereafter.

Each module 20 comprises an active portion 200, a member 210, a cartridge 220 and a mushroom-shaped element 230, as notably shown in FIG. 13. The active portion 200 belongs to the member 210 and is positioned so as to protrude out of the cartridge 220 to an end of the member 210. Except at the level of the active portion 200, the member 210 is housed in the cartridge 220. For its own part, the mushroom-shaped element 230 is secured to the cartridge 220.

Each module 20 includes a substantially planar face 26, formed by the cartridge 220 and provided for sliding along the face 16 of the arm 13. At the centre of the face 26, the module 20 includes two elongated grooves 262 and 264, provided for cooperating with the rib 142 may be made on the face 16. The rib 142 may form a slide connection with the groove 262 or 264, depending on the orientation of the module 20 relatively to the body 10. Each module 20 has an elongated shape between a front end 27 and a rear end 28.

The front end 27 of the module 20 includes a projection 271, an abutment surface 272, a protrusion 273 and an orifice 274. The projection 271 supports the active portion 200, which emerges from the cartridge 200 through the orifice 274. The abutment surface 272 is provided for bearing against the abutment surface 172 made at the entry of the housing 17, while the protrusion 273 is provided so as to be positioned in the recess 173 made in the housing 17, when the front end 27 is housed in the body 10, in the rest configuration C1 of the module 20. Fastening with clips of the module 20 in the body 10 is then achieved by cooperation of the recess 173 and of the protrusion 273.

The rear end 28 of the module 20 includes a boss 281 and an abutment surface 282. The abutment surface 282 is provided for bearing against the abutment surface 172 made at the entry of the housing 17, while the boss 281 is provided so as to be positioned against the surface 171 of the housing 17, when the rear end 28 is housed in the body 10, in the use configuration C2 of the module 20. Jamming of the module 20 in the body 10 is then achieved by cooperation of the surface 171 and of the boss 281.

The modules 20 are different on the example of FIGS. 1 to 28. More specifically, the pen 1 comprises four distinct modules 21, 22, 23 and 24, each including an active portion 201, 202, 203 and 204 different from the other modules. Also, the members 210 and the cartridges 220 have certain differences depending on the modules 20. On the other hand, the mushroom-shaped elements 230 are preferably similar for the whole of the modules 20.

On the non-limiting example of FIGS. 1 to 28, the active portions 200 are a carbon pencil tip 201, a rubber 202, an ink pen tip 203 and an ink eraser tip 204. Other active portions 200 may be applied without departing from the scope of the invention. For example, the active portions 200 of the pen 1 may be selected from among a highlighter, a roller, a re-writer, a white correcting fluid, a color pencil, a felt pen, etc. According to a particular example, the active portions 200 may be four pen tips with four different colors.

Alternatively, the modules 20 or certain modules 20 may include active portions 200 and members 210 which are identical, depending on the needs and on the wishes of the user. In other words, the modules 20 may fulfill different or identical functions depending on the choice of the user.

The cartridge 220 comprises two portions 221 and 222 assembled together in order to form a rigid assembly in one piece, for example by clip-fastening, screwing, adhesive bonding, thermo-welding and/or welding with ultrasonic waves. Depending on the assembling method, either the portions 221 and 222 may be easily disassembled by the user for accessing the inside of the cartridge 220 and to the member 210, or the portions 221 and 222 cannot be disassembled by the user without damaging the cartridge 220.

Preferably, the cartridge 220 comprises at least one external portion 223 specifically adapted for receiving a finger of the user. The portions 223 may have different shapes and layouts depending on the modules 20, as notably shown in FIGS. 1 to 6.

Advantageously, each cartridge 220 has a shape and similar dimensions to the other cartridges 220, while each mushroom-shaped element 230 has a shape and similar dimensions to the other mushroom-shaped elements 230. Thus, the modules 20 are interchangeable and the pen 1 is modular, in a simple and practical way.

Figure 6:
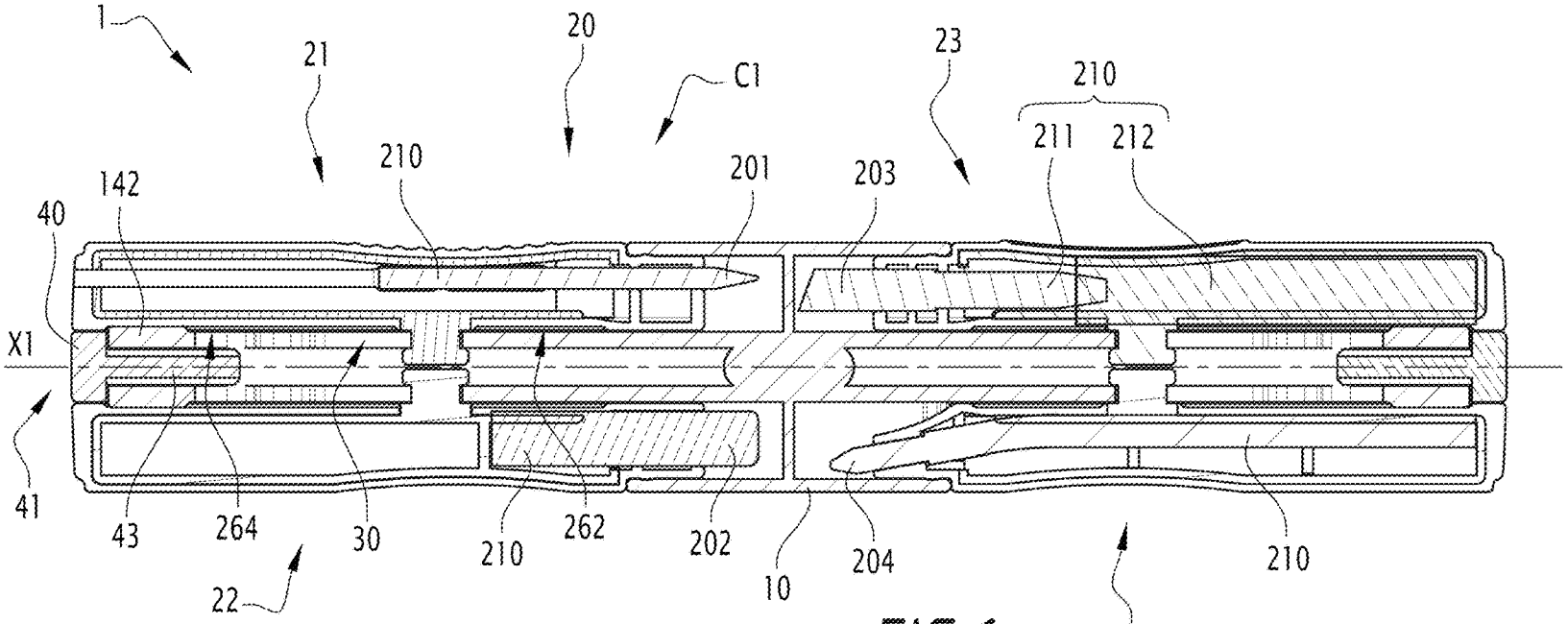
FIG. 6 is a sectional view along the line VI-VI in FIG. 4.

On the other hand, the inner shapes of each cartridge 220 may vary depending on the shapes and on the dimensions of the member 210. In particular, each of the members 210 occupies a more or less significant space in its cartridge 220, as shown in FIG. 6.

According to a first alternative, the member 210 is removable relatively to the cartridge 220, when this cartridge 220 is not disassembled into two separate portions 221 and 222. Thus, the member 210 and therefore the corresponding active portion 200 may easily be replaced.

According to a second alternative, the member 210 is not removable or is only partly removable relatively to the cartridge 220, when this cartridge 220 is not disassembled into two separate portions 221 and 222. For example, in the case of the ink eraser tip 203, the member 210 comprises a tank 211 and a wick 212 partly introduced into this tank 211.

The mushroom-shaped element 230 comprises a rod 231 and a head 232. The mushroom-shaped element 230 is centered on an axis Y20 perpendicular to the face 26. When the module 20 is assembled with the body 10, the axis Y20 is parallel to the Y1 axis. The rod 231 is positioned between the head 232 and the face 26 of the cartridge 220. The rod 231 comprises two flats 233, formed parallel with each other on either side of the axis Y20. The head 232 has a circular sectional shape in a plane perpendicular to the axis Y20. The head 232 is less thick than the rod 231 along a direction parallel to the Y20 axis. The head 232 is wider than the rod 231, wider than the portions 181, 182 and 183, but less wide than the portion 184 of the groove 18, along a direction radial to the Y20 axis. In the example shown in FIG. 10, relative to the module 22, the mushroom-shaped element 230 is secured to the portion 221 of the cartridge 220.

The guiding mechanism 30 gives the possibility of guiding the module 20 in translation and in rotation along the body 10. By means of the mechanism 30, the module 20 is movable relatively to the body 10 between the configurations C1 and C2, successively in translation parallel to the X1 axis and in rotation around the Y30 axis, as detailed hereafter.

The guiding mechanism 30 comprises elements belonging to the body 10 and elements belonging to the modules 20. The mechanism 30 comprises the faces 16, the grooves 18 and the ribs 142 of the body 10. The mechanism 30 also comprises the faces 26, the grooves 262 and the mushroom-shaped elements 230 of the modules 20. For a given module 20, the mechanism 30 in particular comprises one face 16, one groove 18, one face 26 and one mushroom-shaped element 230.

In the embodiment of FIGS. 1 to 28, it is noted that when the modules 20 are all in the rest configuration C1 or all in the use configuration C2, the body 10 and the mechanism 30 are symmetrical with respect to each of the axes X1, Y1 and Z1. In other words, the body 10 and mechanism 30 are symmetrical with respect to a central point located at the intersection of the axes X1, Y1 and Z1, as shown in FIG. 1.

Each cap 40 has a U-shape with a base 41 and two legs 42, as notably shown in FIGS. 5 and 8 to 10. A projection 43 extends from the base 41 between both legs 42. The projection 43 has an I-section in a plane parallel to the base 41 and perpendicular to the legs 42. The ends 44 of the legs 42 each include a recess 45 provided for receiving a protrusion 145 formed at the end 14 of the arm 13, thus allowing formation of a connection by clip-fastening between the cap 40 and the body 10. In each of the two angles between the base 41 and the legs 42, an orifice 46 with a rectangular profile is formed between the base 41, the neighboring leg 42 and the projection 43. The projection 43 is connected to the base 41 and to the legs 42, except at the two ends 45 and at both orifices 46. The orifices 46 are provided for receiving the hooks 143 formed at the end 14 of the arm 13, thus allowing the mobility of the cap 40 to be limited with respect to the body 10 between two positions P41 and P42.

In practice, the cap 40 is movable at the end 14 between a safety position P41 and a release position 42. In the safety position P41, shown in FIGS. 1 to 4, 6 to 9 and 15 to 22, the cap 40 interferes with a portion of the groove 18, more specifically the legs 42 cover the portion 184 of the groove 18, which prevents displacement of the module 20 as far as the setback configuration C5. In the release position P42, shown in FIGS. 23 to 28, the cap 40 is disengaged from the groove 18, more specifically the legs 42 no longer cover the portion 184 of the groove 18, which allows displacement of the module 20 as far as the setback configuration C5.

The pen 1 is mounted in a rest configuration C1 in FIGS. 1, 3, 4 and 6 to 10. More specifically, the four modules 20 are shown in a rest configuration C1, with their active portions 200 which are housed in the body 10.

Figure 2:
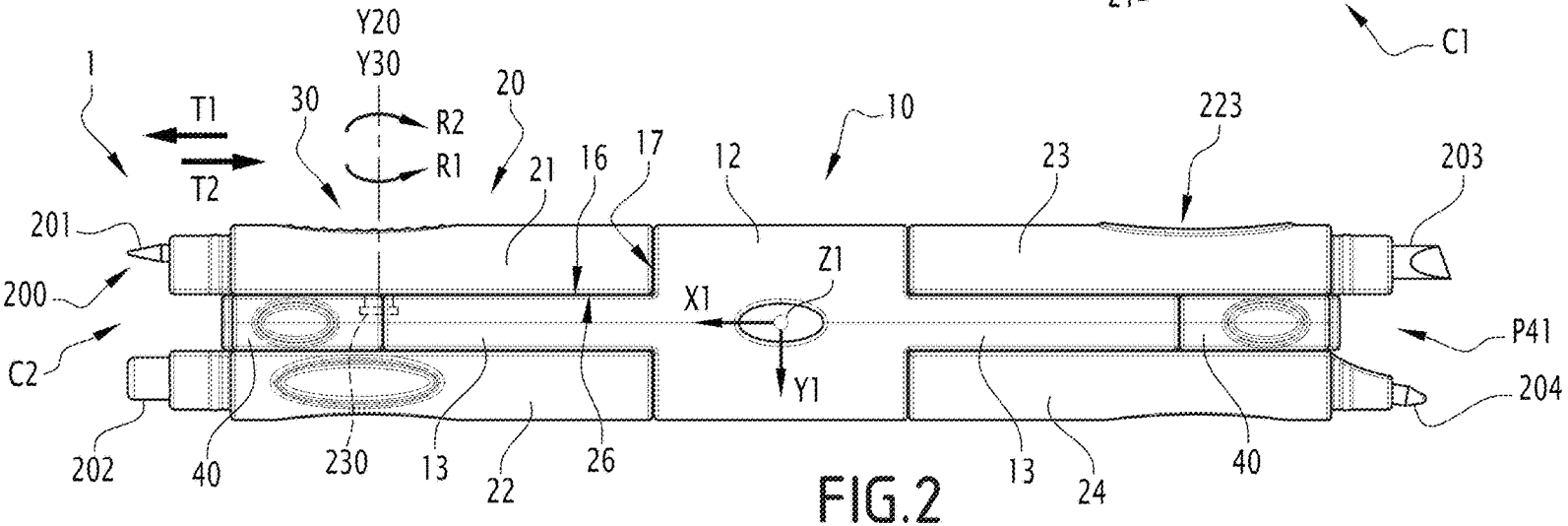
FIG. 2 is a top view of the pen of FIG. 1, the modules being shown in a use configuration.
Figure 3:
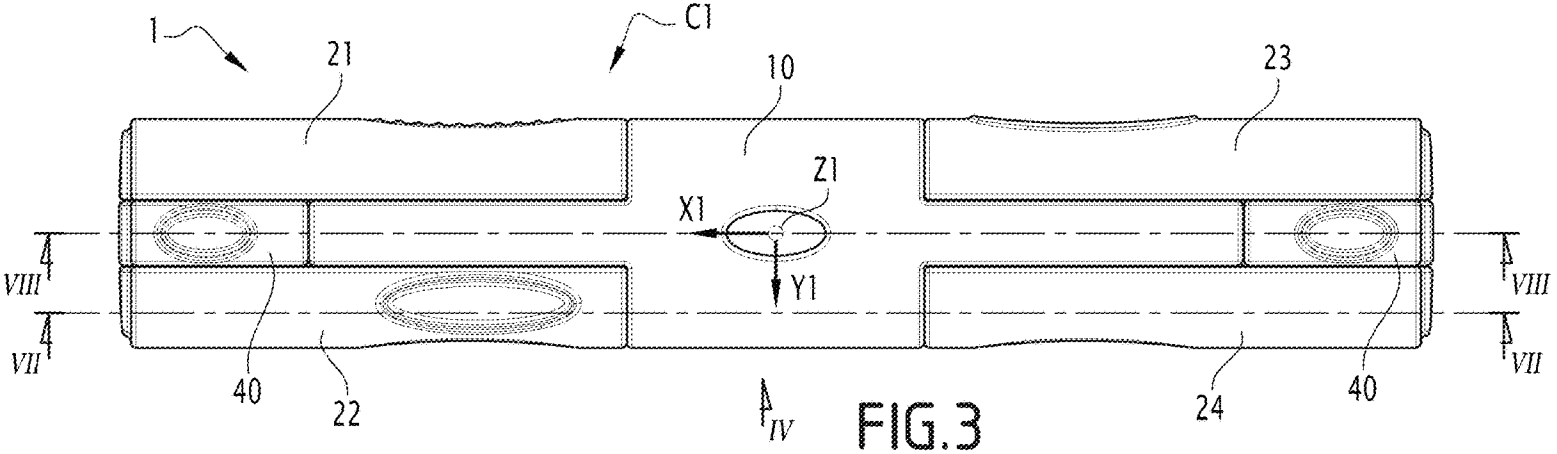
FIG. 3 is a view similar to FIG. 2, the modules being shown in a rest configuration.
Figure 4:
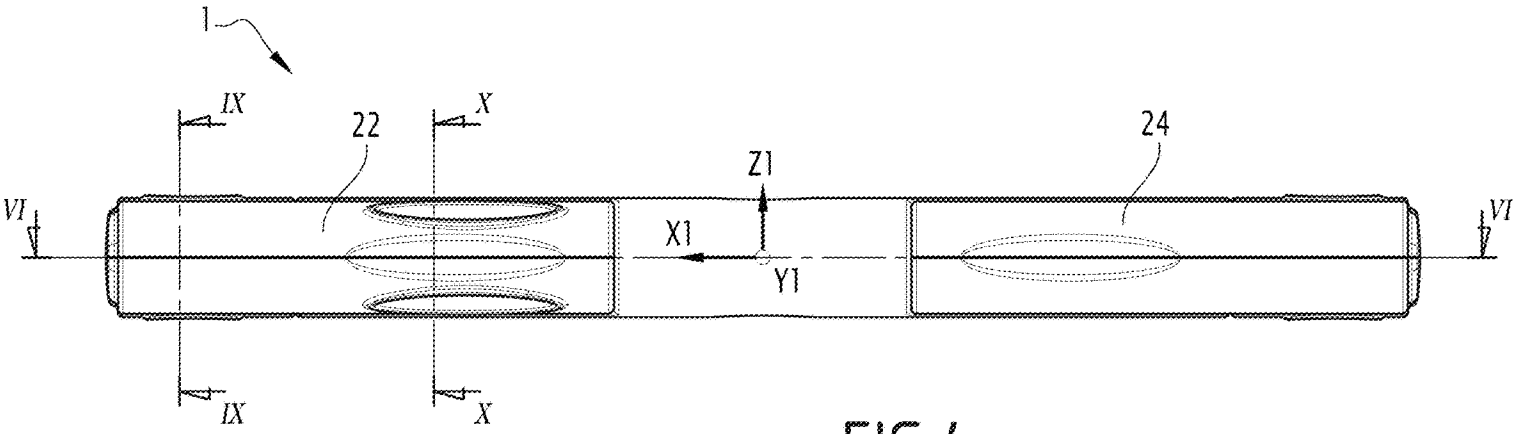
FIG. 4 is a side view along the arrow IV in FIG. 3.

The pen 1 is mounted in a use configuration C2 in FIG. 2. More specifically, the four modules 20 are shown in a use configuration C2, with their active portions 200 which protrude out of the body 10. Generally, it is more practical to position one or two modules 20 in a use configuration C2 at the same time, nevertheless the user may decide to position any number of modules 20 in a use configuration C2. In particular, it is practical to position in a use configuration C2 both modules 20 located on a same side of the pen 1, which gives the possibility of using their active portions 200 alternately in a simple and rapid way. For example, when the modules 21 and 22 are simultaneously in a use configuration C2, the use may alternate rapidly between the pencil tip 201 and the rubber 202. The invention then shows all its potential.

The method for applying the pen 1 is detailed hereafter with reference to FIGS. 15 to 28. More specifically, the application of one of the modules 20, i.e. the module 21, is shown in FIGS. 15 to 28, while the module 22 is in a rest configuration C1.

Figure 15:
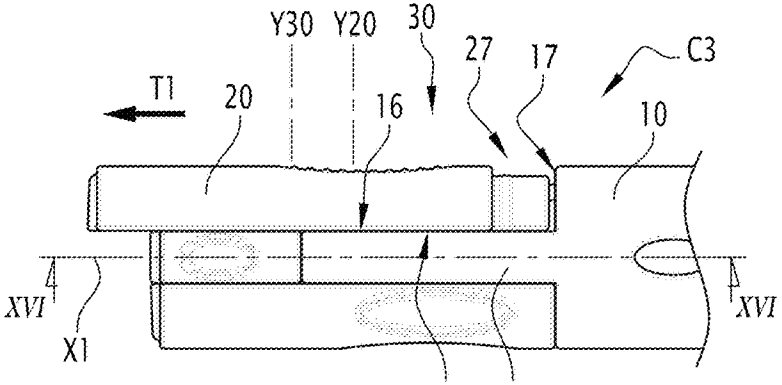
FIG. 15 is a partial view similar to FIG. 2, showing one of the modules in an intermediate configuration, during translation relatively to the body.
Figure 16:
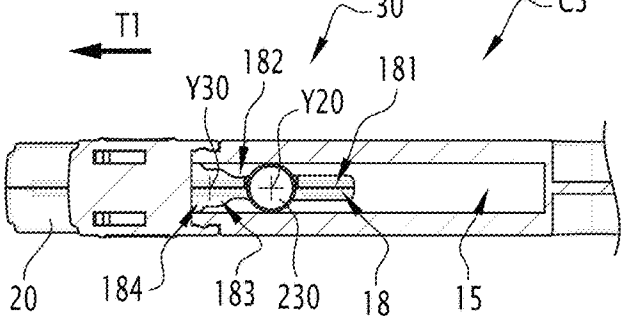
FIG. 16 is a sectional view along the line XVI-XVI in FIG. 15.
Figure 21:
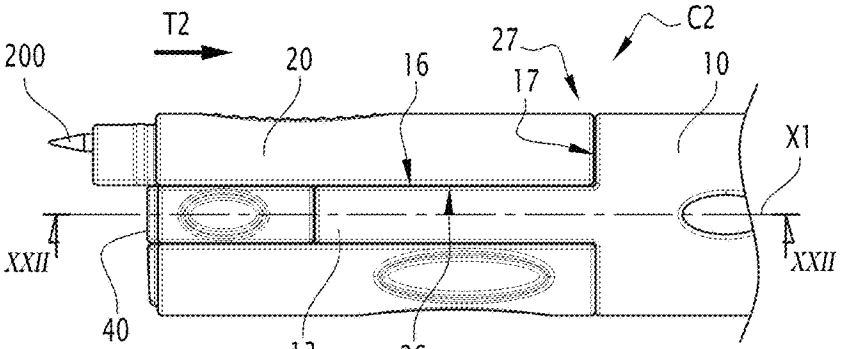
FIG. 21 is a view similar to FIG. 19, showing the module in a use configuration.
Figure 22:
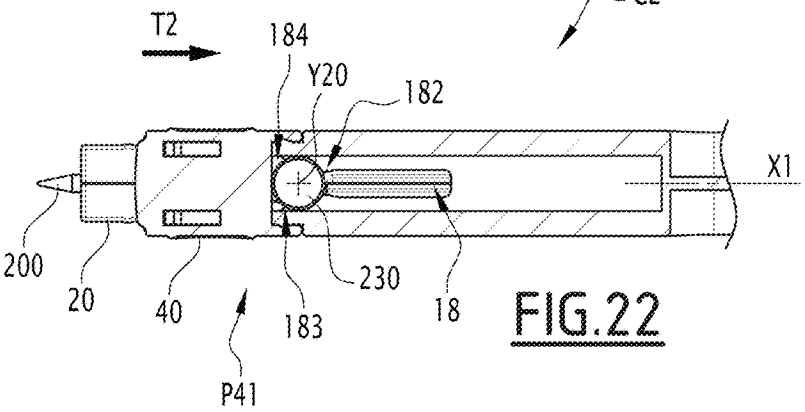
FIG. 22 is a sectional view along the line XXII-XXII in FIG. 21.
Figure 19:
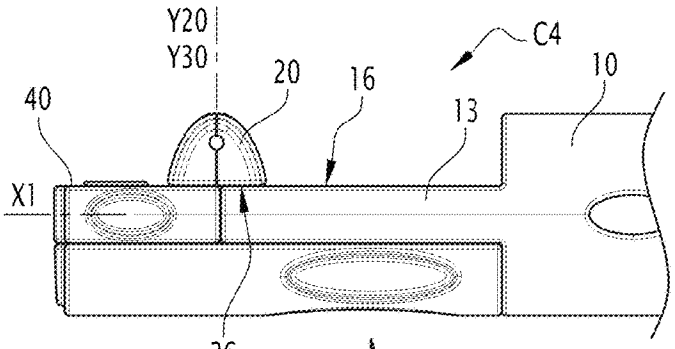
FIG. 19 is a view similar to FIG. 17, showing the module in the pivoting configuration, during rotation relatively to the body.
Figure 20:
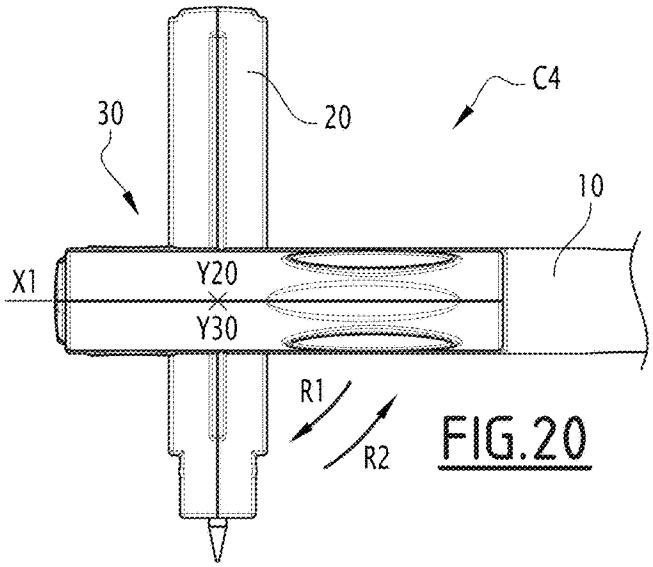
FIG. 20 is a view along the arrow XX in FIG. 19.
Figures 23, 24, 25, 26:
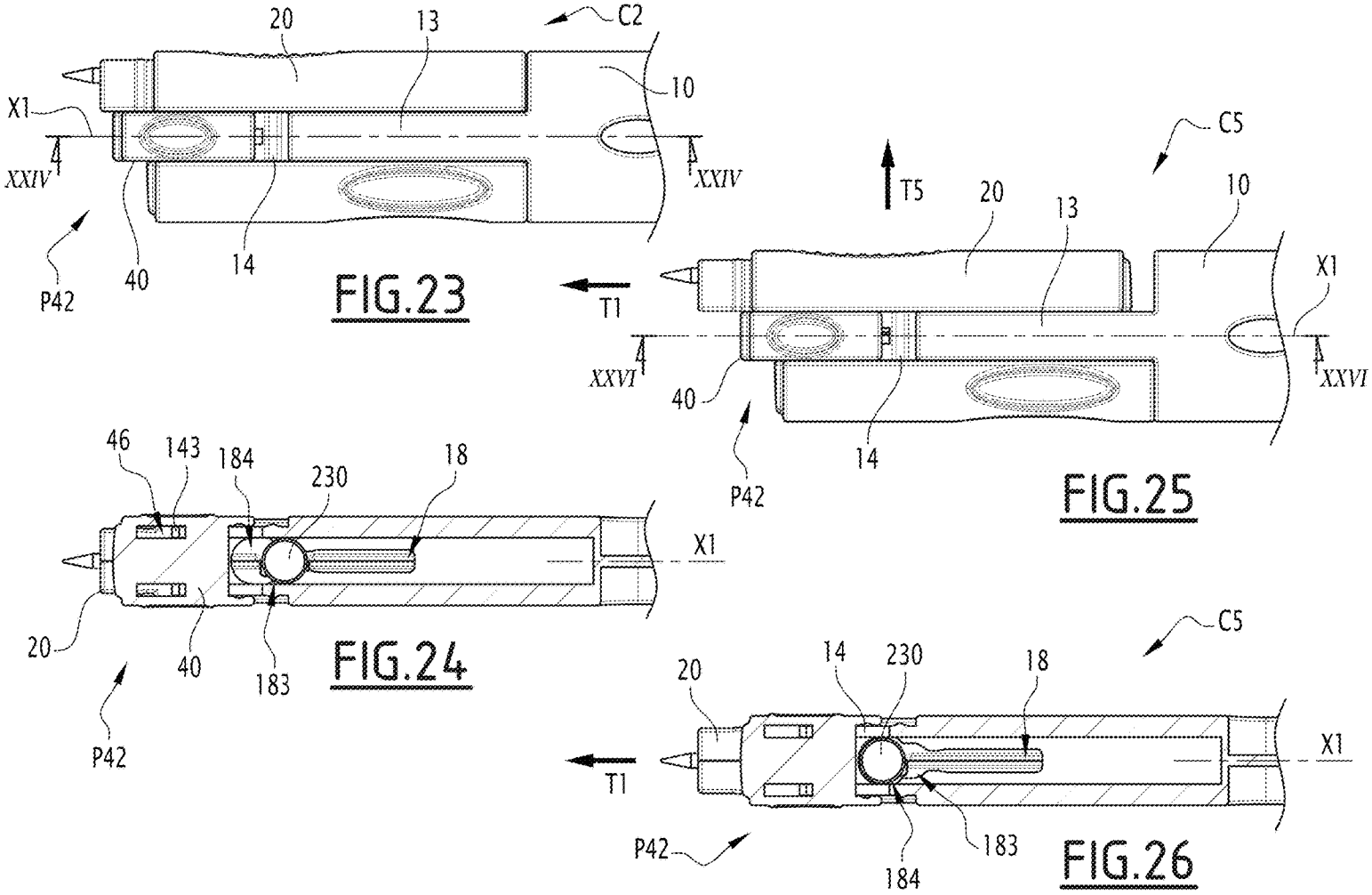
FIG. 23 is a view similar to FIG. 21, showing the cap in a position for releasing the module.
FIG. 24 is a sectional view along the line XXIV-XXIV in FIG. 23.
FIG. 25 is a view similar to FIG. 23, showing the module in a setback configuration.
FIG. 26 is a sectional view along the line XXVI-XXVI in FIG. 25.
Figure 27:
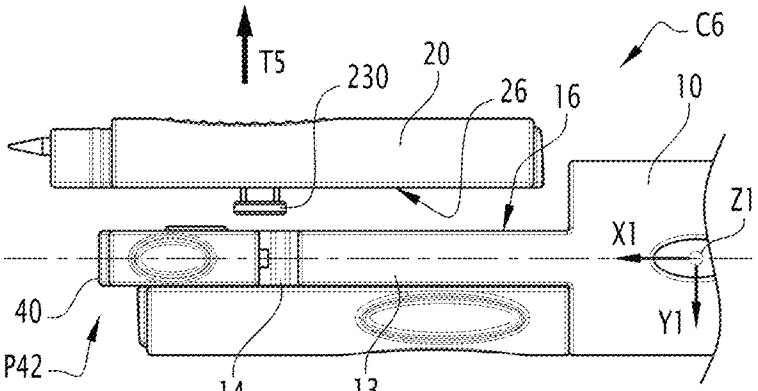
FIG. 27 is a view similar to FIG. 25, showing the module being disassembled relatively to the body.
Figure 28:
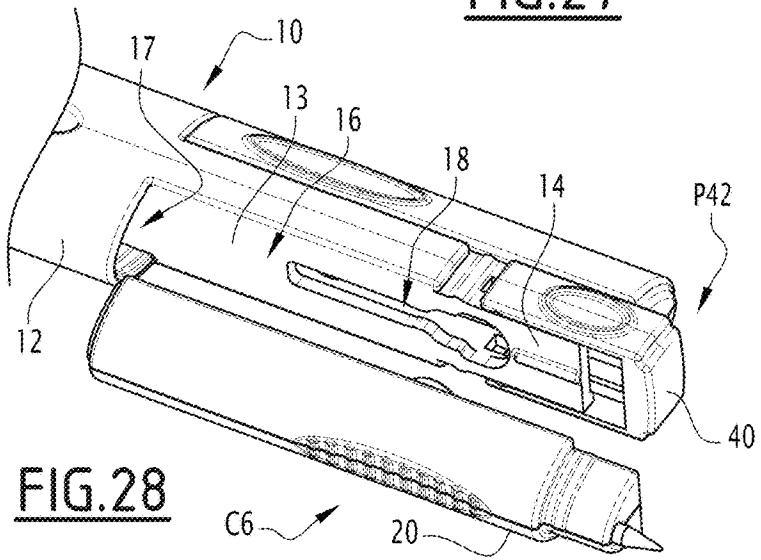
FIG. 28 is a partial perspective view of the pen in the configuration of FIG. 27.

In FIGS. 15 and 16, the module 20 is shown in an intermediate configuration C3 between its rest configuration C1 and its use configuration C2. In FIGS. 17 to 20, the module 20 is shown in a pivoting configuration C4. In FIGS. 21 to 24, the module 20 is shown in a use configuration C2. In FIGS. 25 and 26, the module 20 is mounted in a setback configuration C5. In FIGS. 27 and 28, the module 20 is shown in a disassembled configuration C6. The cap 40 is mounted in a safety position P41 in FIGS. 15 to 22 and in a release position P42 in FIGS. 23 to 28.

In the rest configuration C1, the active portion 200 of the module 20 is housed in the body 10, more specifically in the housing 17. The front end 27 of the module 20 is protected in the housing 17, while that the rear end 28 of the module 20 is located at the cap 40 and at the end 14 of the body 10. The module 20 does not comprise any active portion 200 located out of the body 10, unlike certain existing instruments in which a module comprises an active portion at each of its ends.

In the use configuration C2, the active portion 200 of the module 20 protrudes out of the body 10, while extending beyond the end 14 and the cap 40 along the X1 axis. The rear end 28 of the module 20 is driven into the housing 17, while the front end 27 juts out at the cap 40 and at the end 14 of the body 10. The use may handle the pen 1 in order to apply the active portion 200.

At this stage, it is noted that in each of the configurations C1 and C2, the essential part of the module 20 is located out of the body 10, unlike certain existing instruments, for which in a rest configuration notably, the essential or complete part of the module 20 is located in the body 10. By the essential part of the module 20, is meant at least 50% of the module 20, in the example of FIGS. 1 to 28, in each of the configurations C1 and C2, at least 90% of the module 20 is located out of the body 10.

In the intermediate configuration C3, the mushroom-shaped element 230 is positioned in the portion 181 of the groove 18. The axes Y20 and Y30 are parallel but do not coincide. The head 232 slides in the cavity 15. The rod 231 and in particular the flats 233 slide in the portion 181, while being adjusted against the edges of this portion 181. The module 20 may be moved according to a translational movement T1 or T2, but cannot pivot relatively to the body 10. The translation T1 is directed along a first direction, while the translation T2 is directed along a second direction opposite to the first direction, parallel to the X1 axis.

In order to pass from the intermediate configuration C3 to the pivoting configuration C4, the mushroom-shaped element 230 crosses the portion 182 of the groove 18. The cap 40 in the safety position P41 prevents the mushroom-shaped element 230 from attaining the portion 184.

In the pivoting configuration C4, the mushroom-shaped element 230 is positioned in the portion 183 of the groove 18. The axes Y20 and Y30 coincide. The rod 231 may pivot in the portion 183. The head 232 is wider than the portion 183. The module 20 may pivot around the axis Y30, equally according to the direction of rotation R1 or the direction of rotation R2, but the mushroom-shaped element 230 cannot be withdrawn from the groove 18.

In order to pass from the rest configuration C1 to the use configuration C2, the module 20 successively passes through the configurations C3, and then C4, and then C3. The module 20 is successively movable according to the translation T1 in the C3 configuration, and then according to the rotation R1 or R2 by 180 degrees around the Y30 axis in the C4 configuration, and finally according to the translation T2 in the C3 configuration, as far as the use configuration C2.

In order to return from the use configuration C2 to the rest configuration C1, the module 20 is successively movable according to the translation T2 in the C3 configuration, and then according to the rotation R1 or R2 by 180 degrees around the axis Y30 in the C4 configuration, and finally according to the translation T1 in the C3 configuration, as far as the rest configuration C1.

During the displacements described above, the rotation R1 or R2 may for example be comprised between 175 and 185 degrees around the axis 30, instead of 180 degrees. By attaining the configuration C1 or C2, the end 27 or 28 of the module 20 is adjusted into the housing 17 of the body 10. The module 20 is then aligned with the arm 13.

In order to pass from the rest configuration C1 or from the use configuration C2 to the setback configuration C5, the cap 40 is displaced to the release position P42, and the module 20 is then displaced according to the translation T1, so that the mushroom-shaped element 230 attains the portion 184 of the groove 18.

In the setback configuration C5, the mushroom-shaped element 230 is positioned in the portion 184 of the groove 18. As the head 232 is less wide than the portion 184, the mushroom-shaped element 230 may be withdrawn from the cavity 15 and from the groove 18, by displacing the module 20 according to a translation T5 directed along a direction parallel to the Y30 axis and by moving away from the body 10, as far as the disassembled configuration C6.

In the disassembled configuration C6, the module 20 is no longer secured to the body 10. The module 20 may be reloaded or replaced with another module 20. The old or the new module 20 is positioned on the body 10 in the C5 configuration, and then displaced in the C4 configuration, and then the cap 40 may be displaced from the release position P42 to the safety position P41.

Thus, the invention gives the possibility of displacing the module 20 in a rapid and reliable way between its different configurations. During a given task, the user may use in turn the active portions 200 of the different modules 20, by rapidly passing from one module 20 to the other. The body 10 is the lid giving the possibility of protecting the active portion 200 in the rest configuration C1, which suppresses the requirements of handling such a lid as well as the risk of loosing such a lid. The pen 1 according to the invention is practical, simple and rapid to use, and provides significant customization possibilities.

Figure 29:
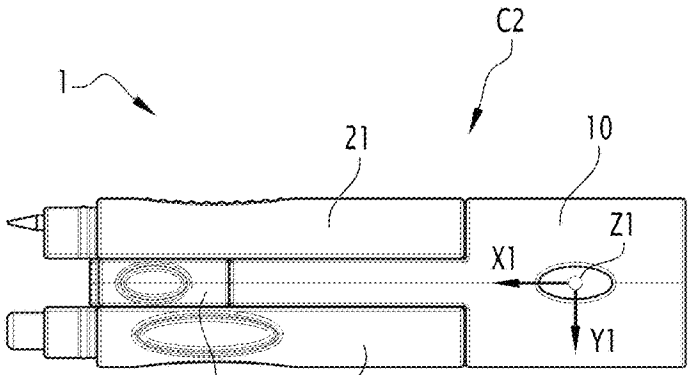
FIG. 29 is a view similar to FIG. 2, showing a second embodiment of a pen according to the invention, comprising two modules.

In FIG. 29 is illustrated a pen 1 according to a second embodiment of the invention. This pen 1 comprises a single arm 13, two modules 21 and 22 positioned on either side of the arm 13, as well as a single cap 40. The body 10 and the mechanism 30 are symmetrical with respect to the longitudinal central axis X1. In fact, the body 10 and the mechanism 30 are symmetrical, on the one hand with respect to a plane comprising the axes X1 and Y1 and, on the other hand with respect to a plane comprising the axes X1 and Z1.

In FIGS. 30 to 39 is illustrated a pen 1 according to a third embodiment of the invention. The elements of the pen 1 of this third embodiment which are similar to those of the first embodiment bear the same references, increased by 1000, and are not described in detail in so far that the description above may be transposed to them.

The pen 1001 comprises a body 1010, four modules 1020 and a guiding mechanism 1030. The pen 1001 has an elongated shape along the X1 axis.

Figure 38:
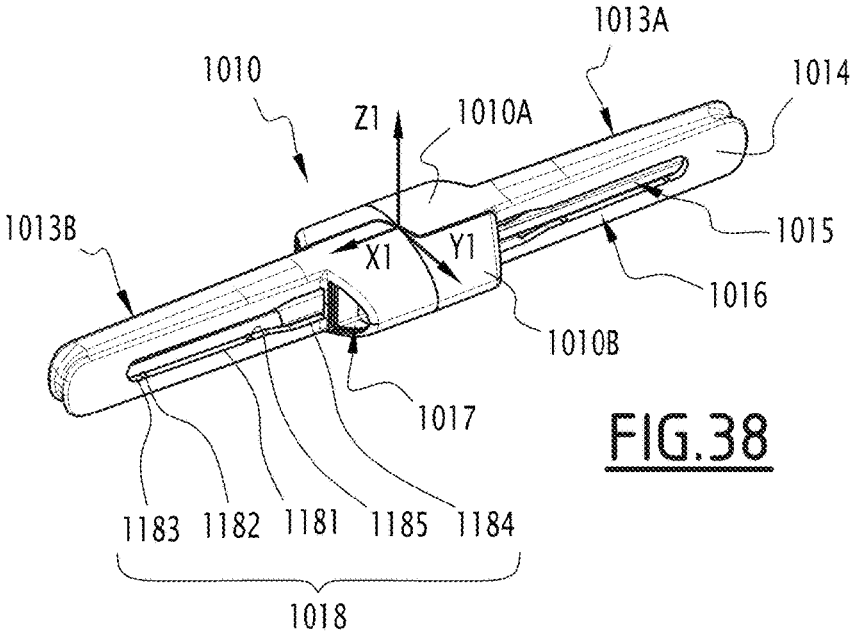
FIG. 38 is a perspective view of the body of the pen in FIG. 30.
Figure 39:
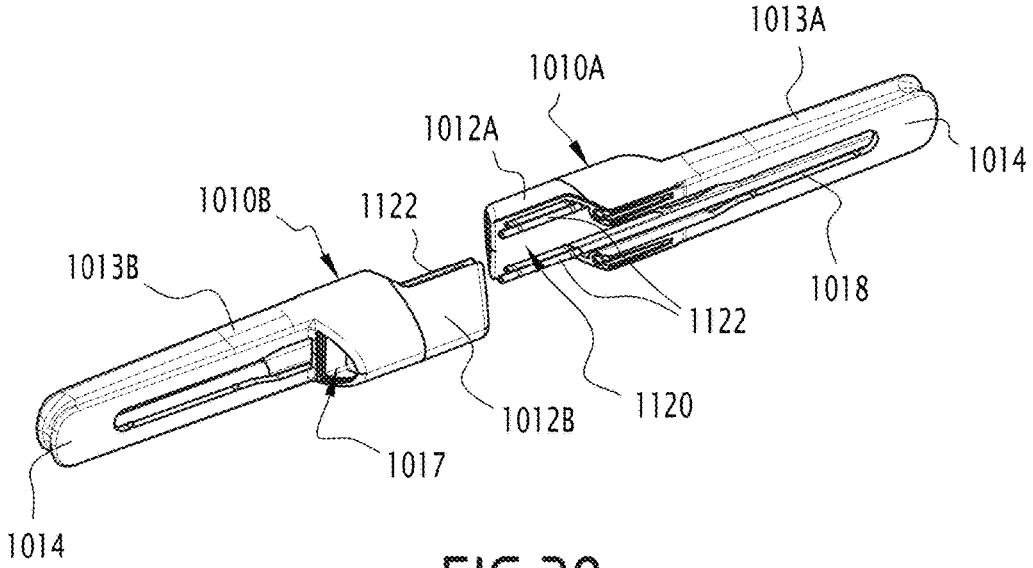
FIG. 39 is an exploded perspective view of the body of FIG. 38.

As visible in FIGS. 38 and 39, the body 1010 is formed by two assembled parts 1010A and 10108. The parts 1010A and 10108 are symmetrical with respect to the X1, Y1 and Z1 axes. The parts 1010A and 10108 are made by injection, molding, machining or any other method suitable for the material used. Each part 1010A and 10108 includes a leg 1012A and 1012B and an arm 1013A and 1013B. Each leg 1012A and 1012B includes a planar surface 1120 and two housings 1017 for receiving an end of the modules 1020. On each surface 1120 of the legs 1012A and 1012B are provided grooves 1122. The grooves 1122 of the leg 1012A are configured so as to engage with the grooves 1122 of the leg 1012B and ensuring the assembling of the parts 1010A and 10108 of the body 1010. The assembling of the parts 1010A and 10108 is achieved by adhesive bonding, welding or any other method.

When the parts 1010A and 10108 are assembled, the legs 1012A and 1012B define together a base 1012. Thus, the body 1010 comprises the base 1012 and both arms 1013A and 1013B.

Each arm 1013A and 1013B extends along the X1 axis, from the base 1012 as far as one end 1014 of the body 1010.

Further, each arm 1013A and 1013B includes two grooves 1018, each provided for receiving the mushroom-shaped element 1230 of a module 1020. Each groove 1018 is formed between the cavity 1015 and the corresponding face 1016.

Each groove 1018 includes various portions 1181, 1182, 1183, 1184 and 1185 connected together. The portion 1181 has an elongated shape along the X1 axis and a reduced width along the Z1 axis. The portions 1182 and 1185 have a localized shrinkage of the groove 1018. In practice, the portions 1182 and 1185 are configured for preventing an inadvertent translational movement T1 or T2 of the module 1020. The portion 1183 has a circular shape having a diameter equal to the width of the portion 1181. The portion 1183 has a central axis Y30, parallel to the Y1 axis. The Y30 axis is fixed relatively to the body 1010, in other words it is secured to the body 1010. The portion 1184 forms a gradual widening of the groove 1018.

Each module 1020 is movable between different configurations C1, C2, C3, C4, C5 and C6, i.e. a rest configuration C1, a use configuration C2, an intermediate configuration C3, a pivoting configuration C4, a setback configuration C5 and a disassembled configuration C6.

The modules 1020 are different on the example of FIGS. 30 to 49. More specifically, the pen 1 comprises four distinct modules 1021, 1022, 1023 and 1024, each including an active portion 1200 different from that of the other modules.

Figure 30:
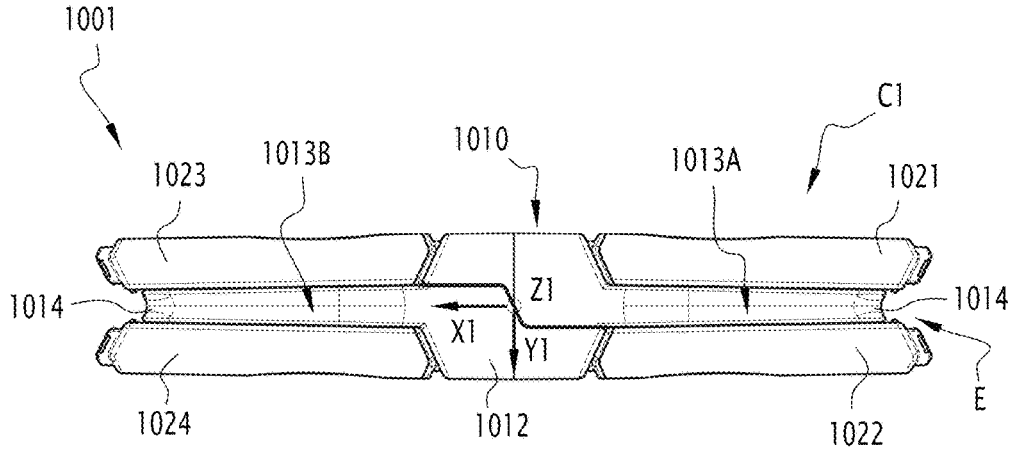
FIG. 30 is a top view of an instrument according to a third embodiment of the invention, of the writing pen type, comprising a body and four modules mounted in a rest configuration.

The pen 1001 is shown in a rest configuration C1 in FIG. 30. More specifically, the four modules 1020 are shown in a rest configuration C1, with their active portions 1200 which are housed in the body 1010.

Figure 34:
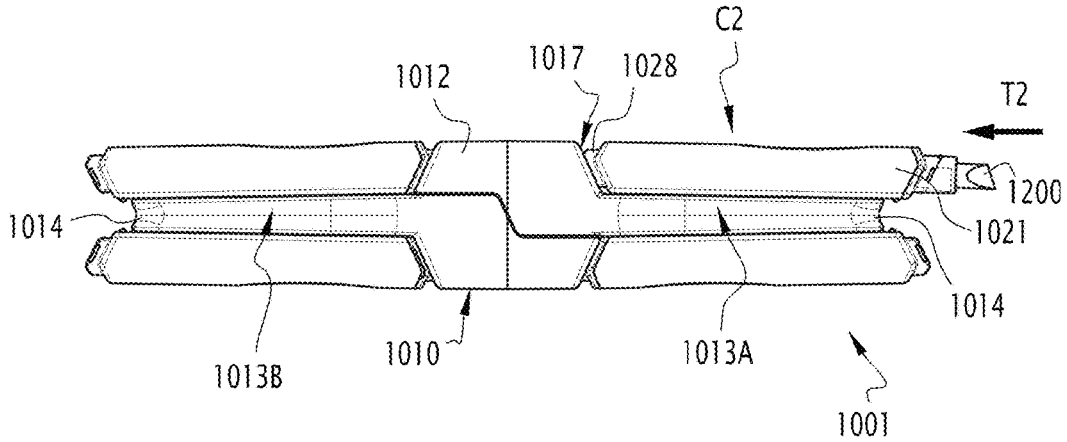
FIG. 34 is a view similar to FIG. 30, showing the module in a use configuration.

The pen 1001 is shown in a use configuration C2 in FIG. 34. More specifically, one of the four modules 1020, for example the module 1021, is shown in a use configuration C2, with its active portion 1200 which is located out of the body 1010.

The method for applying the pen 1001 is detailed hereafter with reference to FIGS. 30 to 39. More specifically, the application of one of the modules 1020, i.e. the module 1021, is shown in FIGS. 30 to 39, while the other modules 1020 are shown in a rest configuration C1.

Figure 31:
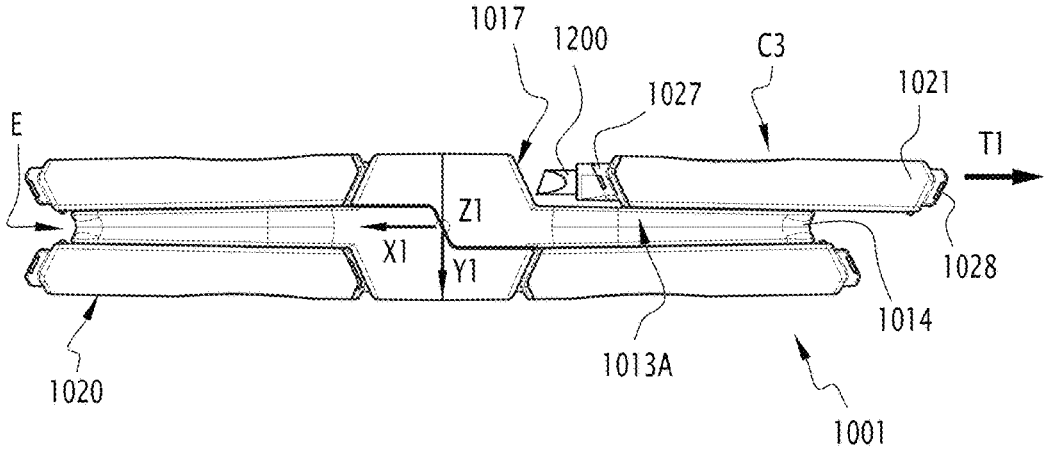
FIG. 31 is a view similar to FIG. 30, showing one of the modules in a pivoting configuration, before rotation relatively to the body.
Figure 32:
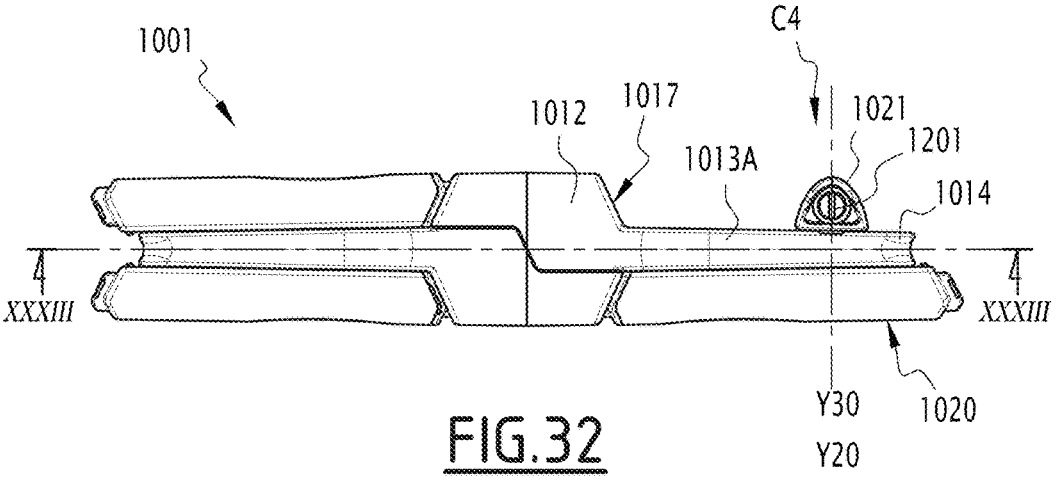
FIG. 32 is a view similar to FIG. 31, showing the module in the pivoting configuration, during rotation relatively to the body.
Figure 33:
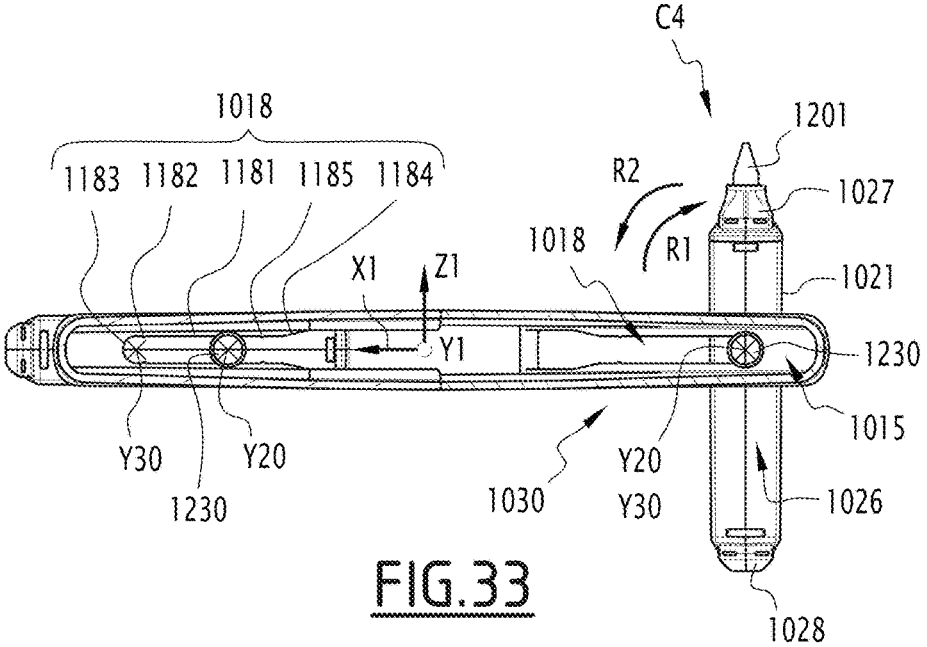
FIG. 33 is a sectional view along the line XXIII-XXIII in FIG. 32.
Figure 35:
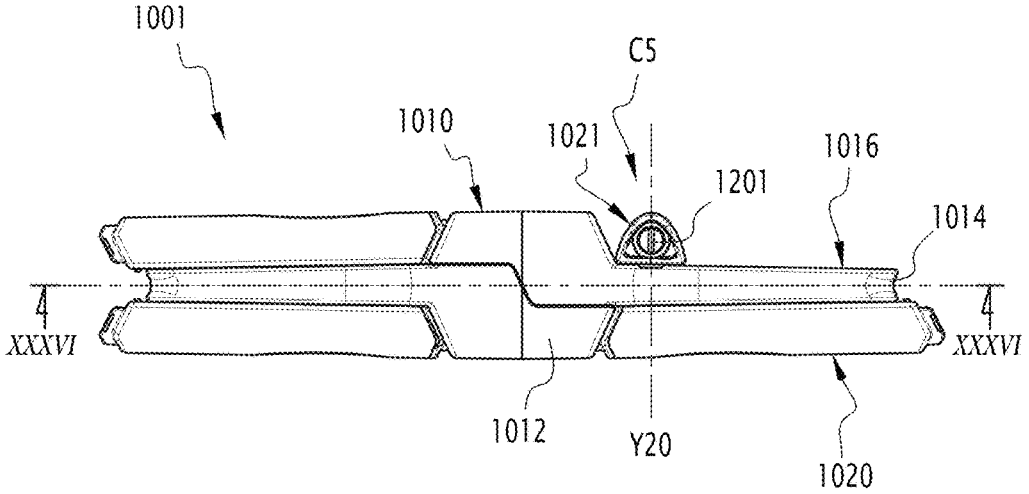
FIG. 35 is a view similar to FIG. 30, showing the module in a setback configuration.
Figure 36:
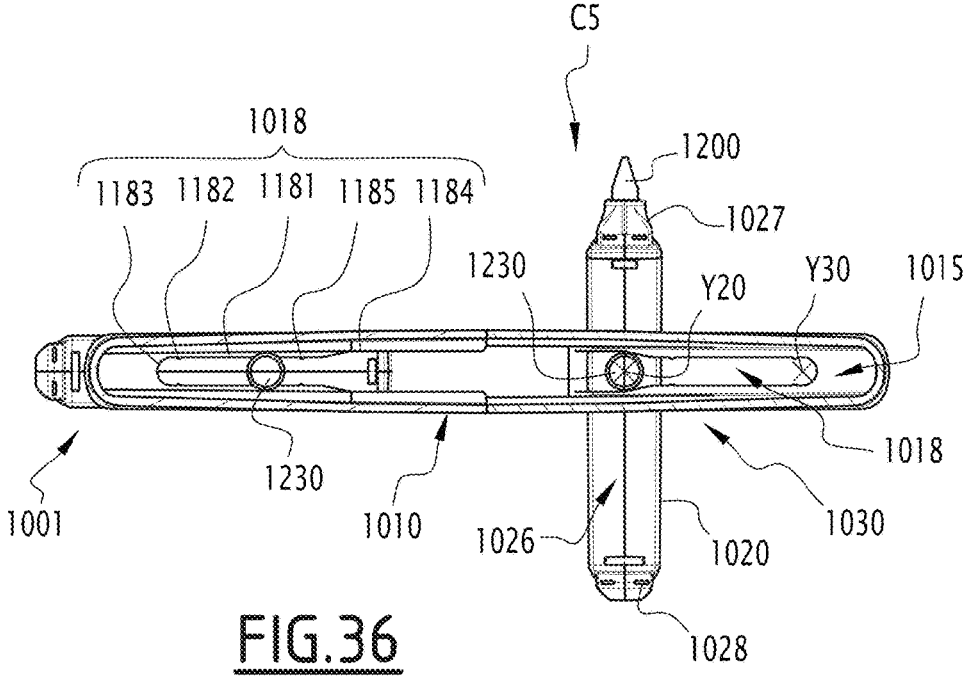
FIG. 36 is a sectional view along the line XXVI-XXVI in FIG. 35.
Figure 37:
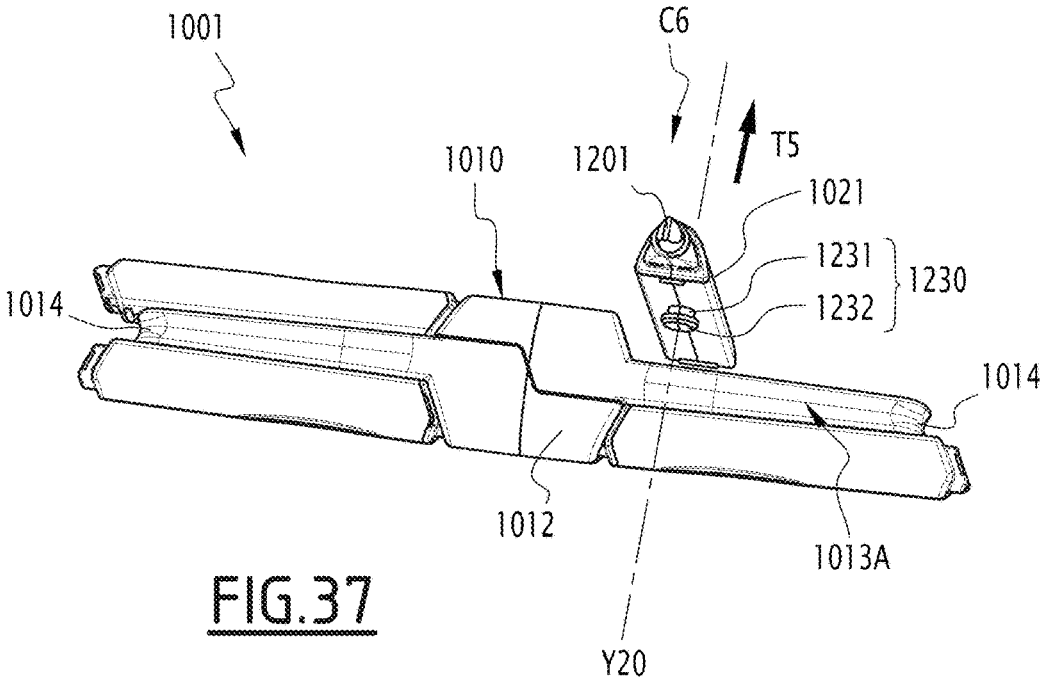
FIG. 37 is a partial view of the pen in FIG. 30, showing the module being disassembled relatively to the body.

In FIG. 31, the module 1020 is shown in an intermediate configuration C3 between its rest configuration C1 and its use configuration C2. In FIGS. 32 and 33, the module 1020 is shown in a pivoting configuration C4. In FIG. 34, the module 1020 is shown in a use configuration C2. In FIGS. 35 and 36, the module 1020 is shown in a setback configuration C5. In FIG. 37, the module 1020 is shown in a disassembled configuration C6.

In the rest configuration C1, the active portion 1200 of the module 1020 is housed in the body 1010, more specifically in the housing 1017. The front end 1027 of the module 1020 is protected in the housing 1017, while the rear end 1028 of the module 1020 is located at the end 1014 of the body 1010. The module 1020 does not comprise any active portion 1200 located out of the body 1010.

In the use configuration C2, the active portion 1200 of the module 1020 protrudes out of the body 1010, in particular beyond the end 1014. In practice, the active portion 1200 of the module 1020 extends along the first axis X1 beyond the end 1014 of the body 1010. For example, when the modules 1021 and 1022 are simultaneously in a use configuration C2, the active portions 1200 of the modules 1021 and 1022 extend along the X1 axis beyond the end 1014 of the body 1010.

In the intermediate configuration C3, the mushroom-shaped element 1230 is positioned in the portion 1181 of the groove 1018. The axes Y20 and Y30 are parallel but do not coincide. The head 1232 slides in the cavity 1015. The rod 1231 slides in the portion 1181, while being adjusted against the edges of this portion 1181. The module 1020 may be displaced according to a translational movement T1 or T2, but cannot pivot with respect to the body 1010. The translation T1 is directed along a first direction, while the translation T2 is directed along a second direction opposite to the first direction, parallel to the X1 axis.

In order to pass from the intermediate configuration C3 to the pivoting configuration C4, the mushroom-shaped element 1230 crosses the portion 1182 of the groove 1018 and is installed in the portion 1183.

In the pivoting configuration C4, the mushroom-shaped element 1230 is positioned in the portion 1183 of the groove 1018. The axes Y20 and Y30 coincide. The rod 1231 may pivot in the portion 1183. The module 1020 may pivot around the axis Y30, equally in the direction of rotation R1 or in the direction of rotation R2, but the mushroom-shaped element 230 cannot be withdrawn from the groove 1018.

In order to pass from the rest configuration C1 to the use configuration C2, the module 20 successively passes through the configurations C3, and then C4, and then C3. The module 1020 is successively movable according to the translation T1 in the C3 configuration, and then according to the rotation R1 or R2 by 180 degrees around the Y30 axis in the C4 configuration, and finally according to the translation T2 in the C3 configuration, as far as the use configuration C2.

In order to return from the use configuration C2 to the rest configuration C1, the module 1020 is successively movable according to the translation T2 in the C3 configuration, and then according to the rotation R1 or R2 by 180 degrees around the Y30 axis in the C4 configuration, and finally according to the translation T1 in the C3 configuration, as far as the rest configuration C1.

In order to pass to the setback configuration C5, the module 1020 has to pass beforehand into the pivoting configuration C4, described above. In practice, the module 1020 may pass to the setback configuration C5 from the rest configuration C1, from the use configuration C2 or from the intermediate configuration C3.

When the module 1020 is in the pivoting configuration C4, the module having pivoted in the direction of rotation R1 or R2 and the mushroom-shaped element 1230 being in the portion 1181 of the groove 1018, the mushroom-shaped element 1230 crosses the portion 1182 and the rod 1231 slides in the portion 1181, while being adjusted against the edges of this portion 1181. The module 1020 moves along a translational movement T2 crosses the portion 1185 of the groove 1018 until the mushroom-shaped element 1230 is positioned in the portion 1184 of the groove 1018. The module 1020 is thus in the setback configuration C5. As the head 1232 is less wide than the portion 1184, the mushroom-shaped element 1230 may then be withdrawn form the cavity 1015 and from the groove 1018, by displacing the modules 1020 according to a translation T5 directed in a direction parallel to the Y30 axis and moving away from the body 1010, as far as the disassembled configuration C6.

In the disassembled configuration C6, the module 1020 is no longer secured to the body 1010. The module 1020 may be reloaded or replaced with another module 1020. The old or the new module 1020 is positioned in the body 1010 in the C5 configuration, and then displaced in the C4 configuration, and then displaced in the C1 or C2 configuration.

The pen 1001 according to the third embodiment of the invention, described above, thus has specificities relatively to the pen 1 according to the first and second embodiments of the invention. Indeed, the pen 1001 does not include any cap 40, or any comparable element to the cap 40 of the pen 1. Thus, a free space E is defined, beyond the end 1014 along the X1 axis, between two modules 1020, in particular between the rear ends 1028 of both modules 1020. The thereby defined free space E is very useful during the use of the pen 1001 by the user.

Generally, it is practical to position in a use configuration C2 both modules 1020 located on the same end 1014 of the body 1010 of the pen 1001. This gives the possibility of using their active portions 1200 alternately in a simple and rapid way. For example, when the modules 1021 and 1022 are simultaneously in a use configuration C2, the use may rapidly alternate between the active portions 1200 of the modules 1021 and 1022. Thus, the free space E promotes visibility to the user of the active portions 1200, so that the use of the pen 1001 is even more facilitated relatively to the pen 1. Indeed, the use may, by retaining a correct attitude, control the position of the active portions 1200 and thus efficiently use the pen 1001.

Moreover, the instruments 1 and 1001 may be conformed differently from the FIGS. 1 to 40 without departing from the scope of the invention.

As a non-illustrated alternative, the instrument 1 or 1001 may be a makeup pen. As non-limiting examples, the active portions 200 or 1200 may be selected from among a paint brush, a brush, an aperture for accessing a makeup reservoir, an end piece of lipstick, etc.

According to another alternative not illustrated, the instrument 1 or 1001 may be a tool, for example a home tool, a do-it-yourself tool, an industrial tool or a surgical tool. As non-limiting examples, the active portions 200 or 1200 may be selected from among a screwdriver tip, a lamp, a file, a blade, a scalpel, a lighter, an electronic cigarette, a laser pointer, etc. According to a particular example, the active portions 200 or 1200 may be four screwdriver tips having different dimensions.

According to another alternative not shown, the instrument 1 or 1001 may be a toy. For example, the active portions 200 or 1200 may be formed with different portions of the body of a character, while other portions of the body and the clothes of this character may be printed on the arms 13 or 1013A and 1013B or on the cartridges 220. The constitutive elements of the character may then be repositioned by translation and/or rotation of the module 20 or 1020 relatively to the body 10 or 1010.

According to another alternative not shown, the body 10 or 1010 of the instrument 1 or 1001 may have any suitable shape for the targeted application. In particular, the spaces 11 for receiving the modules 20 or 1020 may be made at different locations of the body 10 or 1010. Moreover, the body 10 or 1010 may be formed by assembling at least two parts, for example two parts joined in a plane including the X1 and Z2 axes.

According to another alternative not shown, the instrument 1 or 1001 includes a magnet positioned on the body 10 or 1010 and at least one other magnet positioned on the module 20 or 1020. For example, the first magnet may be positioned in the housing 17 or 1017, while a second magnet may be positioned at the front end 27 or 1027 and/or at the rear end 28 or 1028 of the module 20 or 1020. According to a particular embodiment, a second magnet is positioned at the front end 27 and a third magnet is positioned at the rear end 28 of the module 20 or 1020. Further, a set of magnets may be provided for each module 20 or 1020 fitting out the instrument 1 or 1001.

According to another alternative not shown, the instrument 1 or 1001 includes a module 20 positioned between both arms 13 or 1013A and 1013B, instead of two modules 20 or 1020 positioned on either side of a single arm 13 or 1013A and 1013B.

According to another embodiment not shown, the instrument 1 or 1001 includes more than two modules 20 or 1020 on each side, for example three, four or six modules on each side. In this case, the shape of the body 10 or 1010 is adapted accordingly.

According to another alternative not shown, the translation and rotation planes between modules 20 or 1020 and bodies 10 or 1010 are not necessarily parallel or coincident with one module 20 or 1020 to the other.

According to another alternative not shown, the modules 20 or 1020 may have any shapes adapted for the targeted application. For example, the module 20 may include two cartridges 220 secured to each other and each provided with an active portion 200, as well as a mushroom-shaped element 230 or a groove formed on one of the cartridges 220 or both cartridges 220. According to another example, the module 20 may include a single cartridge 220 provided with two active portions 200. In these examples, the active portions 200 are preferably located at the same front end 27 of the module 20, in order to allow them to be housed together in the body 10 in the rest configuration C1. In other words, in the rest configuration C1, the module 20 does not comprise any active portion 200 located out of the body 10.

According to another alternative not shown, the mechanism 30 or 1030 may have elements of any shapes and of any arrangements suitable for the targeted application. For example, the surfaces 16 and 26 or 1016 and 1026 may be without any ribs 142 or any grooves 262. According to another example, the surfaces 16 and 26 or 1016 and 1026 are bulged, with a convex surface and a complementary concave surface, instead of being planar. According to another example, the groove 18 or 1018 is made in the module 20 or 1020 while the mushroom-shaped element 230 or 1230 is secured to the body 10. According to another example, the mechanism 30 or 1030 may include a protruding element having a different shape and/or layout from the mushroom-shaped element 230 or 1230.

According to another alternative not shown, the instrument 1 may be equipped with a blocking device different from the cap 40. For example, a part may be slidably mounted in the arm 13, notably in the cavity 15, so as to selectively obstruct or clear the portion 184 of the groove 18, thereby giving the possibility of blocking or releasing the module 20.

According to another alternative not shown, the instrument 1 may be without any blocking device 40. The setback configuration C5 is then freely accessible from the rest configuration C1 or from the use configuration C2.

According to another alternative not shown, a slot may be made in the arm 13 or 1013A and 1013B perpendicularly to the X1 axis, so as to be able to extract the module 20 or 1020 relatively to the arm 13 or 1013A and 1013B by following this slot.

According to another alternative not shown, the use configuration C2 may be defined so that the module 20 or 1020 is oriented with a particular angle relatively to the arm 13 or 1013A and 1013B, notably oriented at a right angle relatively to the arm 13 or 1013A and 1013B. In this case, the whole of the modules 20 or 1020 may be positioned as an «H» relatively to the body 10 or 1010. According to a particular example, the instrument 1 or 1001 may be conformed like a compass.

Further, the technical characteristics of the different embodiments and alternatives mentioned above may be, in totality or for some of them, combined with each other. Thus, the instrument 1 or 1001 may be adapted in terms of cost, functionalities and ergonomics.

The invention claimed is:

1. An instrument, said instrument comprising:

a body adapted for being grasped by a user;

at least two modules, each module being independent of the other module(s), including an active portion and being movable relatively to the body; and for each module, a mechanism for guiding the module in translation and in rotation along the body, the module being movable relatively to the body successively in a translation parallel to a first axis and in a rotation around a second axis which is perpendicular to the first axis and which is secured to the body, between a rest configuration wherein the active portion of the module is housed in the body and a use configuration wherein the active portion of the module protrudes out of the body, wherein both modules or two of the modules are positioned on either side of a same arm of the body, which extends along the first axis from a base of the body as far as one end of the body, the respective active portions of both of these modules being housed in the base in the rest configuration and extending along the first axis beyond the end of the body in the use configuration.

2. The instrument according to claim 1, wherein the mechanism associated with each module comprises elements belonging to the corresponding arm of the body and of the elements belonging to the module, without any additional part interposed between the body and the module.

3. The instrument according to claim 1, wherein the mechanism associated with each module comprises a surface of the corresponding arm of the body and a surface of the module, both of these surfaces being complementary and sliding against each other during the translation.

4. The instrument according to claim 1, wherein the mechanism associated with each module comprises a groove secured to a first part from among the corresponding arm of the body and the module, this groove defining the second axis, and a protruding element secured to a second part from among the corresponding arm of the body and the module, this protruding element being movable in translation and in rotation in the groove.

5. The instrument according to claim 4, wherein the groove comprises a first portion in which the protruding element is movable in translation but not in rotation and a second portion in which the protruding element is movable in rotation.

6. The instrument according to claim 1, wherein in the rest configuration and in the use configuration, a major part of each module is located out of the body.

7. The instrument according to claim 1, wherein each module is movable towards a setback configuration in which a disassembling of the module relatively to the body is allowed by the associated mechanism, while said disassembling is prevented by the associated mechanism in the rest configuration and in the use configuration.

8. The instrument according to claim 7, wherein the instrument comprises a blocking device which is movable relatively to the body between a safety position, in which the blocking device interferes with a portion of the mechanism for preventing displacement of both modules positioned on either side of the arm, as far as the setback configuration, and a release position in which the blocking device is disengaged from said portion of the mechanism for allowing displacement of both modules positioned on either side of the arm, as far as the setback configuration.

9. The instrument according to claim 8, wherein the blocking device comprises a cap, which is movable relatively to the body between both modules positioned on either side of the arm, between the safety position and the release position.

10. The instrument according to claim 5, wherein each module is movable towards a setback configuration in which a disassembling of the module relatively to the body is allowed by the associated mechanism, while said disassembling is prevented by the associated mechanism in the rest configuration and in the use configuration, and wherein the groove comprises a third portion in which the protruding element is movable in rotation, the mechanism allowing displacement of the modules as far as the setback configuration.

11. The instrument according to claim 1, wherein each module includes an active portion different from that of the other module(s).

12. The instrument according to claim 11, wherein four modules and two arms are provided and wherein the body and the mechanism are symmetrical relatively to a central axis.

13. A method for applying an instrument according to claim 1, wherein a transition of each module from the rest configuration to the use configuration comprises the following steps:

a) displacing the module in translation relatively to the body according to a first direction defined in parallel to the first axis;

b) displacing the module in rotation around the second axis relatively to the body; and c) displacing the module in translation relatively to the body according to a second direction defined in parallel to the first axis and opposite to the first direction, as far as the use configuration.

14. A method for applying an instrument according to claim 8, wherein the disassembling of each module relatively to the body comprises following steps:

a) displacing the blocking device as far as the release position;

b) displacing the module in translation by relatively to the body as far as the setback configuration; and c) displacing the module in translation relatively to the body according to a third direction perpendicular to the first axis, by moving away from the body.

15. A method for applying an instrument according to claim 10, wherein the disassembling of each module relatively to the body comprises following steps:

a) displacing the module in translation relatively to the body according to the first defined direction parallel to the first axis;

b) displacing the module in rotation around the second axis relatively to the body;

c) displacing the module in translation relatively to the body according to the second defined direction parallel to the first axis and opposite to the first direction, as far as the setback configuration, the protruding element being positioned in the third portion of the groove; and d) displacing the module in translation relatively to the body according to a third direction perpendicular to the first axis, by moving away from the body.

* * * * *